US008684673B2

(12) United States Patent
Salazar et al.

(10) Patent No.: US 8,684,673 B2
(45) Date of Patent: Apr. 1, 2014

(54) STATIC SEAL FOR TURBINE ENGINE

(75) Inventors: Santiago Salazar, Orlando, FL (US); Andrew Gisch, Annandale, VA (US)

(73) Assignee: Siemens Energy, Inc., Orlando, FL (US)

( * ) Notice: Subject to any disclaimer, the term of this patent is extended or adjusted under 35 U.S.C. 154(b) by 939 days.

(21) Appl. No.: 12/791,968

(22) Filed: Jun. 2, 2010

(65) Prior Publication Data

US 2014/0003918 A1 Jan. 2, 2014

(51) Int. Cl.
*F16J 15/02* (2006.01)

(52) U.S. Cl.
USPC ..... 415/139; 415/230; 277/644

(58) Field of Classification Search
USPC ..... 415/134–139, 208.2, 209.2, 209.3, 415/214.1, 230; 416/193 A; 277/641–644, 277/647
See application file for complete search history.

(56) References Cited

U.S. PATENT DOCUMENTS

| | | | | |
|---|---|---|---|---|
| 3,529,906 | A | 9/1970 | McLaurin et al. | |
| 3,768,817 | A | 10/1973 | Daniels | |
| 4,650,394 | A * | 3/1987 | Weidner | 415/115 |
| 4,767,260 | A * | 8/1988 | Clevenger et al. | 415/115 |
| 5,531,457 | A | 7/1996 | Tibbott et al. | |
| 5,624,227 | A | 4/1997 | Farrell | |
| 5,865,600 | A | 2/1999 | Mori et al. | |
| 5,868,398 | A | 2/1999 | Maier et al. | |
| 6,193,240 | B1 | 2/2001 | Johnson et al. | |
| 6,273,683 | B1 | 8/2001 | Zagar et al. | |
| 6,722,846 | B2 | 4/2004 | Burdgick | |
| 6,733,234 | B2 | 5/2004 | Paprotna et al. | |
| 6,883,807 | B2 | 4/2005 | Smed | |
| 7,217,081 | B2 | 5/2007 | Scheurlen et al. | |
| 7,445,425 | B2 | 11/2008 | Ferra et al. | |
| 7,527,472 | B2 | 5/2009 | Allen | |
| 7,901,186 | B2 * | 3/2011 | Cornett et al. | 416/198 A |
| 8,382,424 | B1 * | 2/2013 | Liang | 415/115 |

* cited by examiner

*Primary Examiner* — Edward Look
*Assistant Examiner* — Liam McDowell

(57) ABSTRACT

A seal structure for a gas turbine engine, the seal structure including first and second components located adjacent to each other and forming a barrier between high and low pressure zones. A seal cavity is defined in the first and second components, the seal cavity extending to either side of an elongated gap extending generally in a first direction between the first and second components. A seal member is positioned within the seal cavity and spans across the elongated gap. The seal member includes first and second side edges extending into each of the components in a second direction transverse to the first direction, and opposing longitudinal edges extending between the side edges generally parallel to the first direction. The side edges include a groove formed therein for effecting a reduction of gas flow around the seal member at the side edges.

19 Claims, 3 Drawing Sheets

STATIC SEAL FOR TURBINE ENGINE

This invention was made with U.S. Government support under Contract Number DE-FC26-05NT42644 awarded by the U.S. Department of Energy. The U.S. Government has certain rights to this invention.

FIELD OF THE INVENTION

The invention is directed generally to seals for separating gas paths in turbine engines and, more particularly, to static seals between adjacent components forming a barrier between gas paths of a turbine engine, such as components comprising turbine vane shroud assemblies.

BACKGROUND OF THE INVENTION

The main gas-flow path in a gas turbine engine commonly includes a gas intake, a compressor, a combustor, a turbine, and a gas outlet. There are also secondary flows that are used to cool the various heated components of the engine. Mixing of these flows and gas leakage in general, from or into the gas path, is detrimental to engine performance and is generally undesirable.

One particular area in which a leakage path occurs is in the spacing between two gas turbine components such as adjacent vane assemblies or ring segments. Sealing off this leakage path is problematic and various seal designs have been developed to reduce and/or minimize leakage along a lengthwise dimension of the seal, i.e., across a lengthwise edge extending in a generally axial direction of the turbine engine gas path. Accordingly, prior developments in seal designs have typically concentrated on addressing problems comprising, for example, flexibility to compensate for assembly misalignment, different engaging surfaces, vibration from operation, and unequal thermal expansion between adjacent components.

Despite improvements addressing leakage at the lengthwise surfaces of static seals, there continues to be a need to limit or minimize leakage flow between the different gas flow paths on either side of the seal.

SUMMARY OF THE INVENTION

In accordance with an aspect of the invention, a seal structure is provided in a gas turbine engine having an axial gas flow therethrough, the seal structure being provided for minimizing gas leakage between a high pressure zone and a low pressure zone. The seal structure comprises first and second components located adjacent to each other and forming a barrier between the high and low pressure zones. A seal cavity is defined in the first and second components, the seal cavity extending to either side of an elongated gap extending generally in a first direction between the first and second components. A seal member is positioned within the seal cavity and spans across the elongated gap. The seal member comprises first and second side edges extending into each of the components in a second direction transverse to the first direction, and opposing longitudinal edges extending between the side edges generally parallel to the first direction. At least one of the side edges comprises at least one groove formed in the at least one side edge, and has a direction of elongation extending between the longitudinal edges, for effecting a reduction of gas flow around the seal member at the at least one side edge.

In accordance with a further aspect of the invention, a seal structure is provided in a gas turbine engine having an axial gas flow therethrough, the seal structure being provided for minimizing gas leakage between a high pressure zone and a low pressure zone. The seal structure comprises first and second components located adjacent to each other and forming a barrier between the high and low pressure zones. The first and second components include respective component sides facing each other. A seal cavity is defined in the first and second components. The seal cavity extends into the component sides of the first and second components to either side of an elongated gap extending generally in a first direction between the first and second components. A seal member is positioned within the seal cavity and spans across the elongated gap. The seal member comprises first and second side edges extending into each of the components in a second direction transverse to the first direction, and opposing longitudinal edges extending between the side edges generally parallel to the first direction. The seal cavity comprises opposing upper and lower cavity surfaces, and the seal member comprises top and bottom seal surfaces adjacent to the upper and lower cavity surfaces and extending to the side edges. Each of the side edges has a direction of elongation extending between the longitudinal edges and comprises a single groove extending in the direction of elongation along a respective side edge, for effecting a reduction of gas flow around the seal member at the side edges between the high and low pressure zones.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
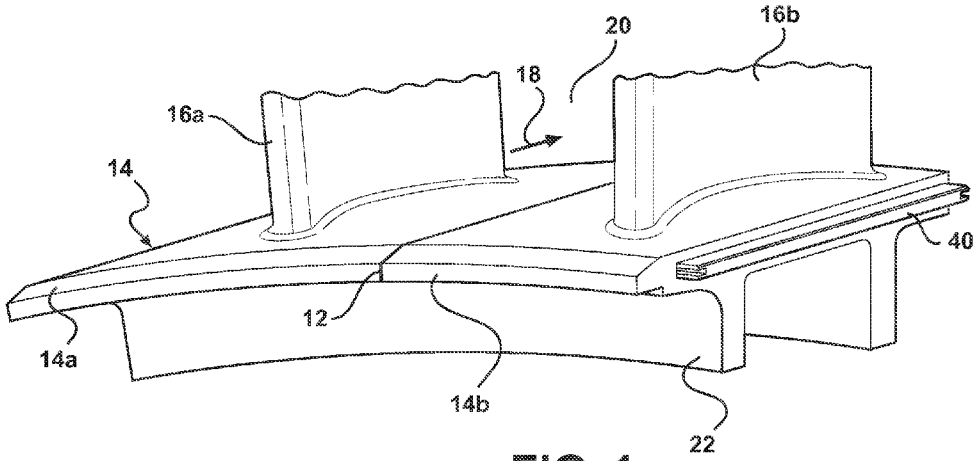
FIG. 1 is a perspective view of a portion of a turbine vane shroud comprising shroud segments and including aspects of the invention.
Figure 2:
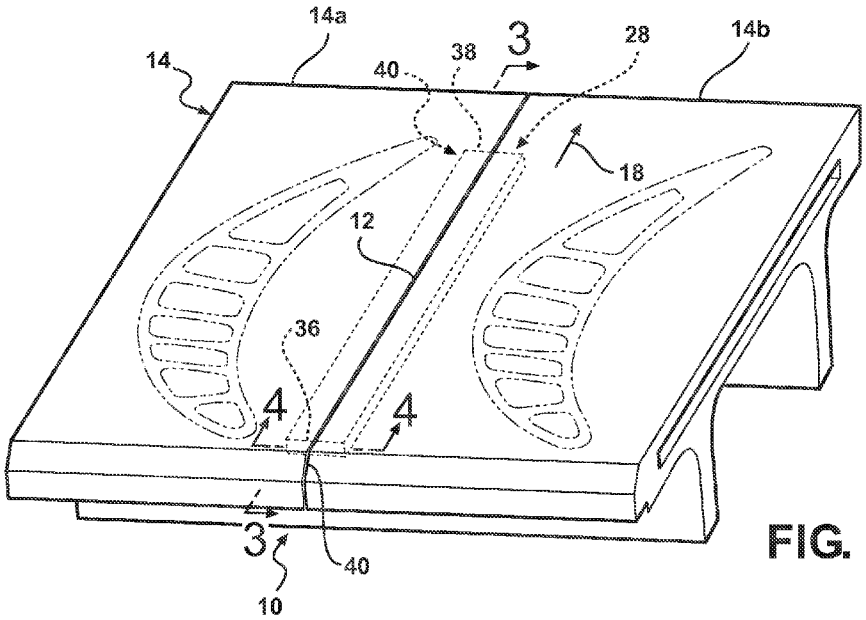
FIG. 2 is a top plan view of a seal structure of the invention.

As seen in FIGS. 1 and 2, the present invention is directed to a seal structure 10 for sealing gaps 12 between adjacent first and second components, such as first and second turbine vane shroud segments 14*a*, 14*b*. The shroud segments 14*a*, 14*b* collectively form a shroud 14 in an engine, such as a gas turbine engine. The first and second shroud segments 14*a*, 14*b* may be associated with respective stationary vanes 16*a*, 16*b*. The shroud 14 defines an inner portion of a gas path for an axial hot gas flow 18, and forms a barrier separating the hot gas flow 18 comprising a low pressure zone 20, on a radially outer side of the shroud 14, from a source of cooling air comprising a high pressure zone 22 defined on a radially inner side of the shroud 14.

It should be noted that although the present invention is described with particular reference to a seal provided to a radially inner shroud 14, the seal structure described herein may be implemented with other adjacent components for minimizing leakage in gaps between the adjacent components. For example, the present seal structure may be implemented to minimize leakage between components forming a shroud ring (not shown) defining a radially outer boundary for the hot gas flow 18.

Figure 4:
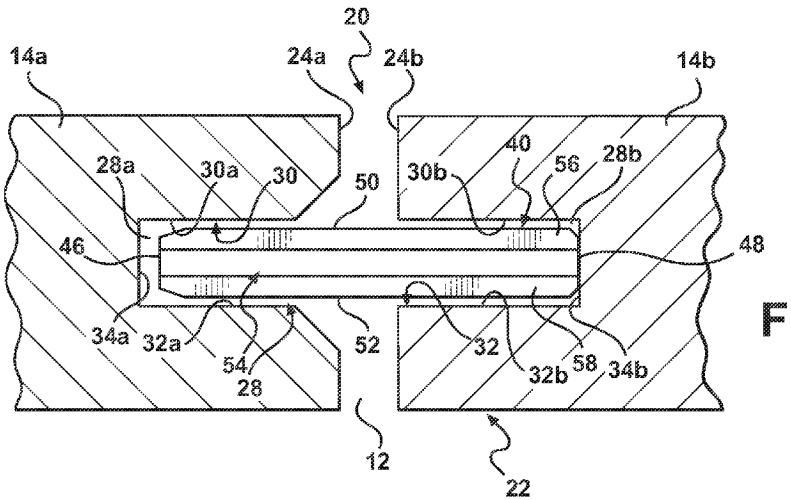
FIG. 4 is a cross-sectional view of the seal structure shown in FIG. 2 taken at line 4-4.

Referring additionally to FIG. 4, the first and second shroud segments 14*a*, 14*b* comprise respective component or shroud segment sides 24*a*, 24*b* located in opposing relation to each other. An elongated gap 12 defined between shroud segment sides 24*a*, 24*b* extends in a first direction that is generally parallel to the direction of hot gas flow 18, see FIG. 2. The seal structure 10 comprises a seal cavity 28 defined in the first and second shroud segments 14*a*, 14*b*. The seal cavity 28 is configured to receive a seal member 40 and extends into the shroud segment sides 24*a*, 24*b*, to either side of the gap 12, and comprises a first cavity portion 28*a* extending into the first shroud segment 14*a* and a second cavity portion 28*b* extending into the second shroud segment 14*b*.

The seal cavity 28 is defined by an upper cavity surface 30 comprising first and second upper cavity surface portions 30*a*, 30*b* in the respective shroud segments 14*a*, 14*b*, and a lower cavity surface 32 comprising first and second lower cavity surface portions 32*a*, 32*b* in the respective shroud segments 14*a*, 14*b*. A first longitudinal wall 34*a* extends between the first upper and lower cavity surface portions 30*a*, 32*a*, and an opposite longitudinal wall 34*b* extends between the second upper and lower cavity surface portions 32*a*, 32*b*. The longitudinal walls 34*a*, 34*b* extend parallel to the direction of the gap 12.

Figure 3:
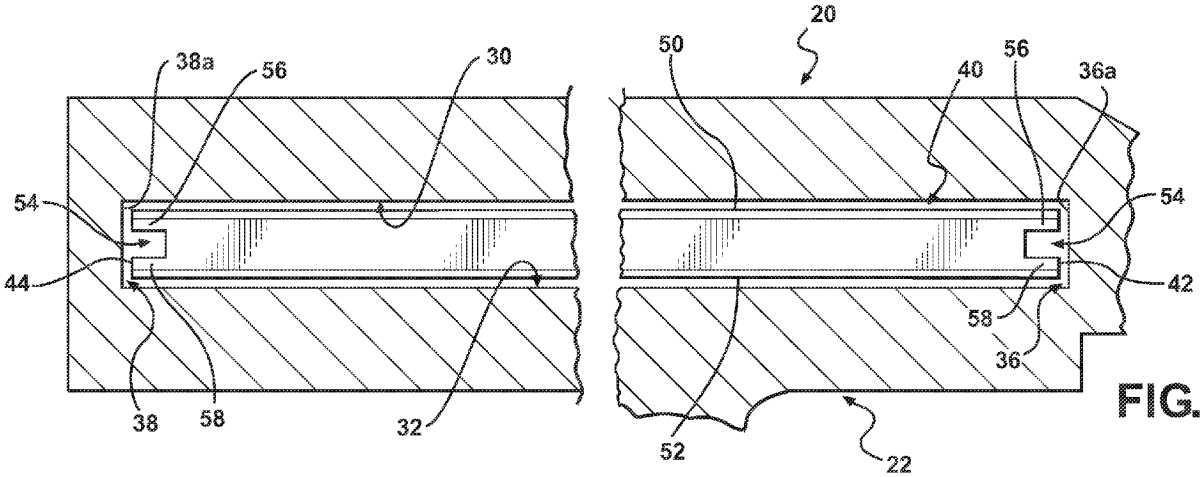
FIG. 3 is a cross-sectional view of the seal structure shown in FIG. 2 taken at line 3-3.

Referring to FIGS. 2 and 3, the seal cavity 28 is further defined by an upstream wall 36 extending between the upper and lower cavity surfaces 30, 32 adjacent an upstream side of the shroud segments 14*a*, 14*b*, and a downstream lateral wall 38 extending between the upper and lower cavity surfaces 30, 32 adjacent a downstream side of the shroud segments 14*a*, 14*b*. The lateral walls 36, 38 extend in a second direction transverse to the first direction, e.g., generally perpendicular to the first direction. It is noted that the lateral walls 36, 38 comprise lateral wall portions of both the first and second shroud segments 14*a*, 14*b* wherein only first upstream and downstream lateral wall portions 36*a*, 38*a* in the first shroud segment 14*a* are identified in FIG. 3, it being understood that the lateral wall portions for the second shroud segment 14*b* are substantially similar to those described herein for the first shroud segment 14*a*.

Figure 5:
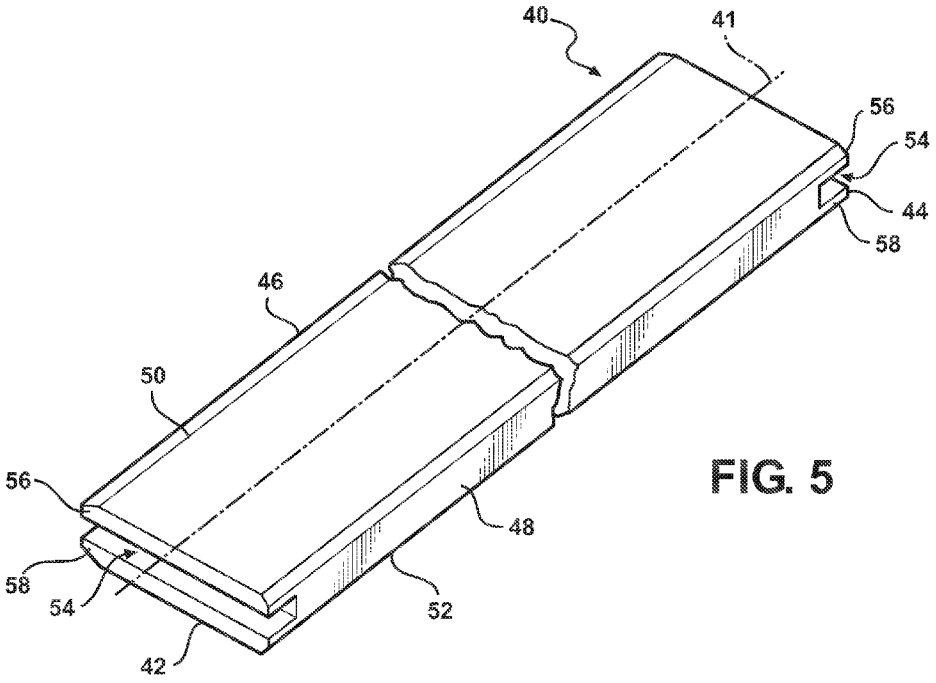
FIG. 5 is perspective view of a seal member for the seal structure.

As shown in FIG. 5, the seal member 40 may be formed as an elongated body, defining a longitudinal axis 41, and configured to fit into the seal cavity 28. The seal member 40 may be formed of a nickel based alloy, such as an alloy sold under the name of INCONEL. The seal member 40 includes opposing, laterally extending side edges 42, 44 that are configured to extend in the second direction into the first and second cavity portions 28*a*, 28*b*. Opposing elongated longitudinal edges 46, 48 extend between the side edges 42, 44, parallel to the longitudinal axis 41 and generally parallel to the first direction when the seal member 40 is positioned within the seal cavity 28. The seal member 40 further comprises a top seal surface 50 and an opposing bottom seal surface 52. The top and bottom seal surfaces 50, 52 may comprise substantially smooth planar surfaces and are located adjacent to the respective upper and lower cavity surfaces 30, 32. It is believed that a substantially smooth planar surface configuration of the seal surfaces 50, 52 provides and optimum engagement surface for sealing engagement with the respective cavity surfaces 30, 32. However, it should be understood that, within the spirit and scope of the present invention, other surface configurations may be provided such as, for example, a riffle seal surface configuration. Further, corners of the elongated longitudinal edges 46, 48 may or may not be filleted or tapered, as shown in FIG. 4.

Figure 6:
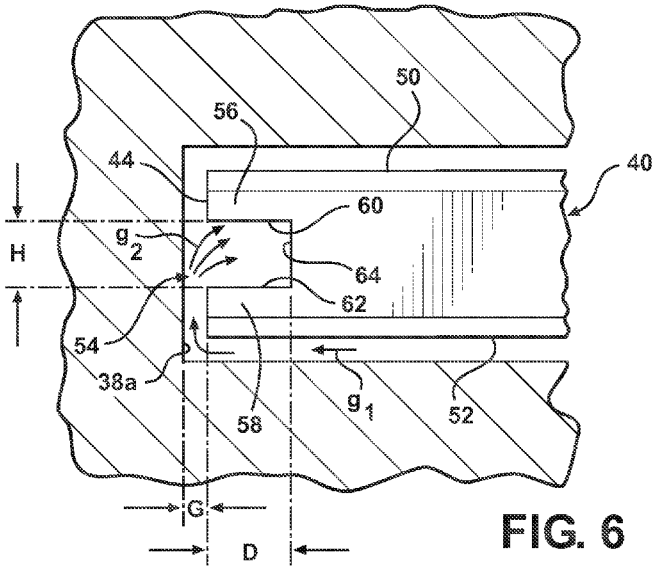
FIG. 6 is an enlarged view of a portion of the seal structure illustrated in FIG. 3 including a portion of a side edge of the seal member.

Referring additionally to FIG. 6, an enlarged view of one of the side edges 44 is shown, where it is understood that the other side edge 42 may be provided with an identical or similar configuration to that described for the side edge 44. The side edge 44 is provided with a flow reducing groove 54 extending along the length of the side edge 44 between the longitudinal edges 46, 48. The groove 54 is positioned generally centrally between the top and bottom seal surfaces 50, 52, and between an upper lip member 56 and a lower lip member 58. The upper lip member 56 is defined between an end portion of the top seal surface 50 and an upper groove wall 60. The lower lip member 58 is defined between an end portion of the bottom seal surface 52 and a lower groove wall 62. The upper and lower groove walls 60, 62 define interior surfaces of the groove 54, extending generally parallel to the top and bottom seal surfaces 50, 52, and are connected by a base wall section 64 extending therebetween.

A gap G between the ends of the lips 56, 58 and the lateral wall portion 38*a* defines a narrow passage that may be in the range of about 0.002 inch to about 0.02 inch. The groove 54 may define a height H that is at least approximately 50% of the thickness of the seal member 40, defined as the distance between the top and bottom seal surfaces 50, 52, and the height H may be at least approximately 40% of the spacing between the upper and lower cavity surfaces 30, 32. Further, a depth D of the groove 54 may be at least approximately four times the dimension of the narrow passage defined by the gap G.

By way of a particular exemplary embodiment of the invention, the seal member 40 may have a thickness of approximately 0.125 inch for being received in a cavity defining a spacing between the upper and lower surfaces 30, 32 that may be in a range of about 0.140 inch to about 0.152 inch. The groove 54 may have a height H of approximately 0.065 inch and a depth D of approximately 0.08 inch, with a gap G between the seal member lips 56, 58 and the lateral wall portion 38*a* of the cavity 28 of approximately 0.02 inch, where a 0.02 inch gap is considered to be an average value for the gap G during steady state operating conditions. It should be noted that the dimensions given in the exemplary embodiment are only for illustrative purposes, and that particular dimensions, including the relative dimensions between the seal member 40 and the cavity 28, are based on guidelines that may vary depending on a particular application in a turbine engine.

As discussed above, prior art seal designs have generally addressed leakage of gases across the longitudinal edges of the seal members, based on the assumption that leaks around static seals are evenly distributed. That is, prior approaches to reducing leakage generally focused on leakage per unit length of the seal, with a resulting focus on reductions in flow across the longer or longitudinal edges of the seal. In accordance with the present invention, it is now understood that, in prior art seals, a substantial volume of gas may leak between high and low pressure zones across the lateral edges of seals currently in use, where the leakage per unit length along the lateral edges may be substantially greater than the leakage per unit length along the longitudinal edges.

In view of the additional understanding of leakage flow provided by the present invention, the groove 54 provided in the side edges 42, 44 of the present seal member 40 effects a reduction in velocity for gas flowing from the high pressure zone 22 to the low pressure zone 20 across the lateral or side edges 42, 44. In particular, as a gas, such as cooling air, flows from the high pressure zone 22 toward the groove 54 (see gas flow $g_1$ in FIG. 6), the spacing between the end of the lower lip 58 and a respective longitudinal wall 34*a*, 34*b* of the seal cavity 28, i.e., the gap G, restricts the flow of gas, and the groove 54 provides an expansion area of reduced pressure where the gas diffuses into the groove 54, increasing the pressure drop across the lower lip 58. The increase in pressure drop at the groove 54 results in a decrease in velocity of gas flowing across the side edges 42, 44, with a resultant decrease in volume of gas flowing across the side edges 42, 44 from the high pressure zone 22 to the low pressure zone 20 (see gas flow $g_2$).

In addition, it is believed that providing a substantially smooth planar surface for the top and bottom seal surfaces 50, 52 of the seal member 40, when properly seated in steady state operating conditions, substantially minimizes the flow of gas between the top and bottom seal surfaces 50, 52 and respective adjacent upper and lower cavity surfaces 30, 32. In particular, when properly seated within the cavity 28, the seal member 40 will be positioned with the top seal surface 50 in engagement with the upper cavity surface 30, as a result of gas from the high pressure zone 22 applying pressure against the bottom seal surface 52 of the seal member 40. The cooperating flat surfaces of the top seal surface 50 and upper cavity surface 30 operate to further restrict flow passing from the high pressure zone 22 to the low pressure zone 20 across the side edges 42, 44 of the seal member 40.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. In a gas turbine engine having an axial gas flow therethrough, a seal structure for minimizing gas leakage between a high pressure zone and a low pressure zone, the structure comprising:

first and second components located adjacent to each other and forming a barrier between the high and low pressure zones;

a seal cavity defined in the first and second components, the seal cavity extending to either side of an elongated gap extending generally in a first direction between the first and second components, the first direction extending generally parallel to the axial gas flow;

the seal cavity including lateral wall portions formed in each of the components extending in a second direction transverse to the first direction;

a seal member positioned within the seal cavity and spanning across the elongated gap;

the seal member comprising first and second side edges extending into each of the components in the second direction transverse to the first direction, and opposing longitudinal edges extending between the side edges generally parallel to the first direction; and at least one of the side edges comprising at least one groove formed in the at least one side edge, and having a direction of elongation extending between the longitudinal edges transverse to the first direction, the at least one side edge located adjacent to the lateral wall portions for effecting a reduction of gas flow around the seal member at the at least one side edge.

2. The seal structure of claim 1, wherein the groove comprises a single groove formed in the at least one side edge, the groove comprising opposing groove walls extending in the direction of elongation of the groove and a base wall section extending between the groove walls.

3. The seal structure of claim 2, wherein the seal member comprises top and bottom seal surfaces extending to the at least one side edge, and upper and lower lip members defined between the top and bottom seal surfaces and respective groove walls, the upper and lower lip members defining an opening to the groove therebetween.

4. The seal structure of claim 3, wherein a gap between ends of the lip members and an adjacent wall of the seal cavity define a narrow passage to diffuse gas flowing into the groove and effect a reduction of velocity for gas flowing from the high pressure zone toward the low pressure zone.

5. The seal structure of claim 4, wherein the narrow passage comprises a gap of approximately 0.02 inch between the ends of the lip members and the adjacent wall of the seal cavity.

6. The seal structure of claim 4, wherein a distance from the ends of the lip members to the base wall of the groove is approximately four times the distance of the gap between ends of the lip members and the adjacent wall of the seal cavity.

7. The seal structure of claim 3, wherein the groove walls are spaced apart at least approximately 50% of a spacing between the top and bottom seal surfaces.

8. The seal structure of claim 1, wherein the seal cavity comprises upper and lower cavity surfaces and the seal member comprises top and bottom seal surfaces adjacent to the upper and lower cavity surfaces, the top and bottom seal surfaces comprising substantially smooth planar surfaces.

9. The seal structure of claim 1, wherein the first and second components comprise turbine vane shrouds located adjacent to each other.

10. In a gas turbine engine having an axial gas flow therethrough, a seal structure for minimizing gas leakage between a high pressure zone and a low pressure zone, the structure comprising:

first and second components located adjacent to each other and forming a barrier between the high and low pressure zones, the first and second components including respective component sides facing each other;

a seal cavity defined in the first and second components, the seal cavity extending into the component sides of the first and second components to either side of an elongated gap extending generally in a first direction between the first and second components, the first direction extending generally parallel to the axial gas flow;

the seal cavity including upstream and downstream lateral wall portions formed in each of the components extending in a second direction transverse to the first direction;

a seal member positioned within the seal cavity and spanning across the elongated gap;

the seal member comprising first and second side edges extending into each of the components in the second direction transverse to the first direction, and opposing longitudinal edges extending between the side edges generally parallel to the first direction;

the seal cavity comprising opposing upper and lower cavity surfaces, and the seal member comprising top and bottom seal surfaces adjacent to the upper and lower cavity surfaces and extending to the side edges; and each of the side edges having a direction of elongation extending between the longitudinal edges and comprising a single groove extending in the direction of elongation along a respective side edge transverse to the first direction, the side edges located adjacent to respective ones of the upstream and downstream lateral wall portions for effecting a reduction of gas flow around the seal member at the side edges between the high and low pressure zones.

11. The seal structure of claim 10, where the grooves comprise opposing groove walls defining interior surfaces of the grooves extending in the direction of elongation of the grooves and a base wall section extending between the groove walls.

12. The seal structure of claim 11, wherein the seal member comprises upper and lower lip members defined between the top and bottom seal surfaces and respective groove walls, the upper and lower lip members defining an opening to the respective grooves therebetween.

13. The seal structure of claim 12, wherein a gap between ends of the lip members and an adjacent wall of the seal cavity define a narrow passage to diffuse gas flowing into the grooves and effect a reduction of velocity for gas flowing from the high pressure zone toward the low pressure zone.

14. The seal structure of claim 13, wherein the narrow passage comprises a gap of approximately 0.02 inch between the ends of the lip members and the adjacent wall of the seal cavity.

15. The seal structure of claim 13, wherein a distance from the ends of the lip members to the base wall of a respective groove is approximately four times the distance of the gap between ends of the lip members and the adjacent wall of the seal cavity.

16. The seal structure of claim 10, wherein the groove walls of each groove are spaced apart at least approximately 50% of a spacing between the top and bottom seal surfaces.

17. The seal structure of claim 10, wherein the top and bottom seal surfaces comprising substantially smooth planar surfaces.

18. The seal structure of claim 10, wherein the first and second components comprise turbine vane shrouds located adjacent to each other.

19. The seal structure of claim 10, wherein the second direction is generally perpendicular to a direction of the axial gas flow.

* * * * *